US005327841A

United States Patent [19]

Sakuma

[11] Patent Number: 5,327,841

[45] Date of Patent: Jul. 12, 1994

[54] THREADING MACHINE OF A SEWING MACHINE AND A THREADING METHOD

[75] Inventor: Kouichi Sakuma, Yamagata, Japan

[73] Assignee: Suzuki Manufacturing, Ltd., Japan

[21] Appl. No.: 906,299

[22] Filed: Jul. 1, 1992

[30] Foreign Application Priority Data

Feb. 24, 1992 [JP] Japan ..... 4-036749

[51] Int. Cl.[5] ..... D05B 1/10; D05B 57/06

[52] U.S. Cl. ..... 112/262.1; 112/162; 112/197

[58] Field of Search ..... 112/225, 302, 262.1, 112/199, 162, 197, DIG. 3

[56] References Cited

U.S. PATENT DOCUMENTS

| | | | |
|---|---|---|---|
| 981,125 | 1/1911 | Schoenfeld | 112/225 |
| 2,413,014 | 12/1946 | Wall | 112/225 |
| 3,508,690 | 4/1970 | Pozzolo | 112/225 X |
| 3,540,392 | 11/1970 | Kaplan | 112/225 |
| 3,763,804 | 10/1973 | Reich | 112/225 |
| 4,023,512 | 5/1977 | Miyamoto | 112/225 X |
| 4,075,959 | 2/1978 | Zocher | 112/225 |
| 4,188,896 | 2/1980 | Brown et al. | 112/225 |
| 4,198,915 | 4/1980 | Peterson et al. | 112/225 |
| 4,325,314 | 4/1982 | Niem | 112/302 X |
| 5,165,582 | 11/1992 | Andrews | 112/225 X |

FOREIGN PATENT DOCUMENTS

| | | | |
|---|---|---|---|
| 3710231 | 6/1988 | Fed. Rep. of Germany | 112/302 |
| 59-118191 | 7/1984 | Japan | 112/302 |
| 63-240895 | 10/1988 | Japan | 112/302 |

*Primary Examiner*—Clifford D. Crowder
*Assistant Examiner*—Paul C. Lewis
*Attorney, Agent, or Firm*—Lorusso & Loud

[57] ABSTRACT

Upper and lower loopers 2 and 3 are annular loopers. A pump 4 for supplying pressurized air is connected to thread introduction portions 7, which are connected to thread inlets of the loopers through annular conduits 5 and 6 and conduits 5' and 6'. The conduits 5' and 6' are slidable relatively to the conduits 5 and 6, and are connected to thread inlets of the loopers in the threading operation. In this state, the pressurized air is supplied from the pump 4 to the thread introduction portion 7, whereby the thread is transferred by the flow of the air and is fed to an outlet of the annular looper. A connecting portion moving plate 10 for connecting the conduits 5' and 6' is positioned in a disengaged position during the operation of the sewing machine by a stopper 18 and is positioned in an engaged position during a threading operation.

16 Claims, 11 Drawing Sheets

41

41
7
5

7
d3
l1
7a
5

41
5

41
7b
5

THREADING MACHINE OF A SEWING MACHINE AND A THREADING METHOD

BACKGROUND OF THE INVENTION

1. Field of the Invention

The present invention relates to a threading device a sewing machine, and particularly to a threading device for automatically passing a thread through a looper of a sewing machine such as a hemstitch overlock machine a double-loop machine, using pressurized gas.

2. Description of the Background Art

As shown in FIG. 11, a hemstitch over-lock machine is an one-needle/three-thread overlock machine including a needle 31*a*, which is fixed to a needle rod 30 adapted to move substantially vertically in synchronization with a main shaft and is inclined with respect to a cloth feeding direction. The needle 31*a* penetrates a needle plate 34 and moves substantially vertically. The one-needle/three-thread overlock machine further includes a lower looper 33, which reciprocates under a needle plate 34 along an arc-shaped path crossing a path of the needle 31, and an upper looper 32, which reciprocates along an elliptical path. This elliptical path crosses the path of the lower looper 33 at the side of the needle plate 34 and crosses the path of the needle 31 above the needle plate 34. The one-needle/three-thread overlock machine operates to form a seam in cloth by crossing a needle thread passed through the needle 31, a lower looper thread S2 passed through the lower looper 33 and an upper looper thread S1 passed through the upper looper 32.

In this overlock machine, as shown in FIG. 12, the upper looper 32 is provided at the vicinity of its tip end with a thread outlet, i.e., thread hole 32*a* through which the upper looper thread S1, guided by an upper looper thread guide 35, is passed and drawn out. Also, as shown in FIG. 12, the lower looper 33 is provided at the vicinity of its tip end with a thread outlet, i.e., thread hole 33*a* through which the lower looper thread S2 is drawn out. A thread holding portion 33*b* is provided with a thread groove 33*c* so as not to disturb the lower looper thread S2, and a thread guide 33*d* is provided at the rear portion of the looper. The lower looper thread S2 guided by a lower looper thread guide 36 is retained on a lower looper thread guide 37, and then is retained on the thread guide 33*d* at the rear portion of the looper before being passed through the thread hole 33*b* at the tip end. A portion of the lower looper thread S2 between the thread guide 33*d* at the rear of the looper and the thread hole 33*b* is accommodated and retained in the thread groove 33*c*.

In the upper and lower loopers 32 and 33 in the prior art, fine work, using tweezers, was required, for passing the thread through the thread hole 32*b* in the upper looper and the thread hole 33*b* in the lower looper, engaging the thread on the thread guide 33*d* at the rear of the looper, and accommodating the lower looper thread S2 in the thread groove 33*c*. Further, the thread is passed through the looper part in a complicated manner, as shown in FIG. 12, so that one may make a mistake in the sequence for passing the threads (for example, in the hemstitch overlock machine, the sequence is 1: upper looper thread, 2: lower looper thread, 3: needle thread), resulting in problems such as thread breakage at the beginning of the sewing operation and needle breakage. Since the thread groove 33*c* provided in the thread holding portion 33*b* for the lower looper thread S2 is open at the front surface, the accommodated lower looper thread S2 may dangle from the thread groove 33*c* and become entangled with the other thread, resulting in trouble. Since the loopers 32 and 33 are attached to a narrow portion under the throat plate 34, it is difficult to access them with a fingertip or tweezers, and skill is particularly required for passing the thread through the lower looper thread guide 33*d* of the lower looper 33 and the thread hole 33*a* in the lower looper 33 which are located at deep positions. An unskilled person cannot correctly pass the threads, or a long time is required for passing the threads, so that the operation must be interrupted for a long time. During the sewing operation, the entanglement of the threads, which results during a restoring operation, e.g., after the thread breakage, may cause thread breakage again.

In order to overcome these disadvantages, a threader or a threading device has been used (disclosed, e.g., in the Japanese Laid-Open Patent Publication No. 1-303194), or such a method has been employed wherein the looper drive is provided with a clutch, and the threading operation is facilitated by laying or inclining the looper by switching the clutch. However, the threading device has disadvantages such as a complicated structure, unstable operation, and skill required for operation. Also it is difficult for an operator to understand the manner for using the threading device, and thus the sewing machine may be broken due to maloperation.

On the other hand, the applicant has proposed a tubular looper shown in FIG. 2, overcoming the above-noted disadvantages, in which the looper has a hollow structure extending from a thread introduction opening to a tip thread outlet (Japanese Patent Application No. 2-310938). In this looper, the thread does not extend through a complicated thread guide as in the prior art shown in FIG. 12, and the threading operation is complicated only by passing the upper and lower looper threads, which are drawn from thread tensioners, through the tubular loopers via the thread guides 35 and 36.

In the structure employing the tubular loopers, the threading paths are simplified to some extent, and the entanglement and breakage of the threads can be prevented. However, the operation for passing the thread through the tubular looper is a manual operation, so that the threading operation is still troublesome.

Accordingly, it is an object of the invention to provide a threading device of a sewing machine, overcoming the above-noted disadvantages deriving from a thread guide having an extremely complicated structure. Another object of the invention is to provide a threading device of a sewing machine and a threading method, in which a thread can be automatically and quickly passed through a looper, using pressurized gas. Still another object of the invention is to provide a threading device of a sewing machine, in which a thread can be passed selectively through a plurality of loopers. Yet another object of the invention is to provide a threading device of a sewing machine, which can prevent malfunction of a main shaft in a threading operation and malfunction of a threading operation during rotation of the main shaft.

SUMMARY OF THE INVENTION

In order to achieve the above objects, the present invention provides a threading device for passing a thread through a looper of a sewing machine comprising a hollow thread guide means for guiding the thread drawn from a tension disc to a thread inlet in the looper. Also, the present invention provides a threading device for passing a thread through a looper of a sewing machine comprising gas supply means for supplying pressurized gas; thread guide means connected to the gas supply means; and a thread introduction portion connected to the thread guide means; the thread guide means having one end which can be connected to one end of the looper. The looper preferably has a hollow structure extending from the thread inlet to a tip thread outlet. A threading device of a sewing machine according to the invention may comprise connecting means for connecting the thread guide means to one end of the looper. Also, in a threading device of a sewing machine according to the invention, a looper thread take-up for feeding the thread may be disposed between the thread guide means and one end of the looper. In a threading device of a sewing machine according to the invention, the gas supply means is preferably connected to the thread guide means through a gas introduction pipe of a diameter smaller than that of the thread guide means.

Further, the present invention provides a threading device for passing threads through a plurality of loopers of a sewing machine, respectively, and comprises gas supply means for supplying pressurized gas, a plurality of thread guide means which are connected to the gas supply means and correspond in number to the loopers, respectively; and a plurality of thread introduction portions connected to the thread guide means, respectively. Each thread guide means has one end which can be connected to one end of each looper. Preferably, the gas supply means includes selector means for feeding the pressurized gas selectively to one of the plurality of thread guide means.

Further, a threading device of a sewing machine according to the invention may comprise a safety device which inhibits the rotation of a main shaft and enables the operation of the connecting means when the main shaft of the sewing machine is in a predetermined position. In a threading device of a sewing machine according to the invention, the thread guide means may include valve means for closing its thread guide passage.

A threading method for a sewing machine according to the invention comprises the steps of: supplying pressurized gas through a thread guide means to a thread inlet of a tubular looper, which has a hollow structure extending from a thread inlet to a tip thread outlet, inserting a thread into a thread introduction portion connected to the thread guide means; supplying the pressurized gas to a gas introduction pipe to generate a negative pressure within the thread guide means; drawing the thread into the thread guide means by utilizing the negative pressure; and feeding the thread to the tip thread outlet of the tubular looper by the flow of the pressurized gas. Also, a threading method for a sewing machine comprises the steps of: supplying pressurized gas through a thread guide means to a thread inlet of a tubular looper, which has a hollow structure extending from the thread inlet to a tip thread outlet; inserting a thread into a thread introduction portion connected to the thread guide means; closing a thread passage of the thread guide means and generating a negative pressure by a reverse operation of the pressurized gas supply means to draw the thread into the thread guide means; then supplying the pressurized gas to the thread guide means by positive operation of the pressurized gas supply means to feed the thread through the tip thread outlet of the tubular looper by the flow of the pressurized gas.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Now, an embodiment of the invention will be described below with reference to the drawings.

Figure 1:
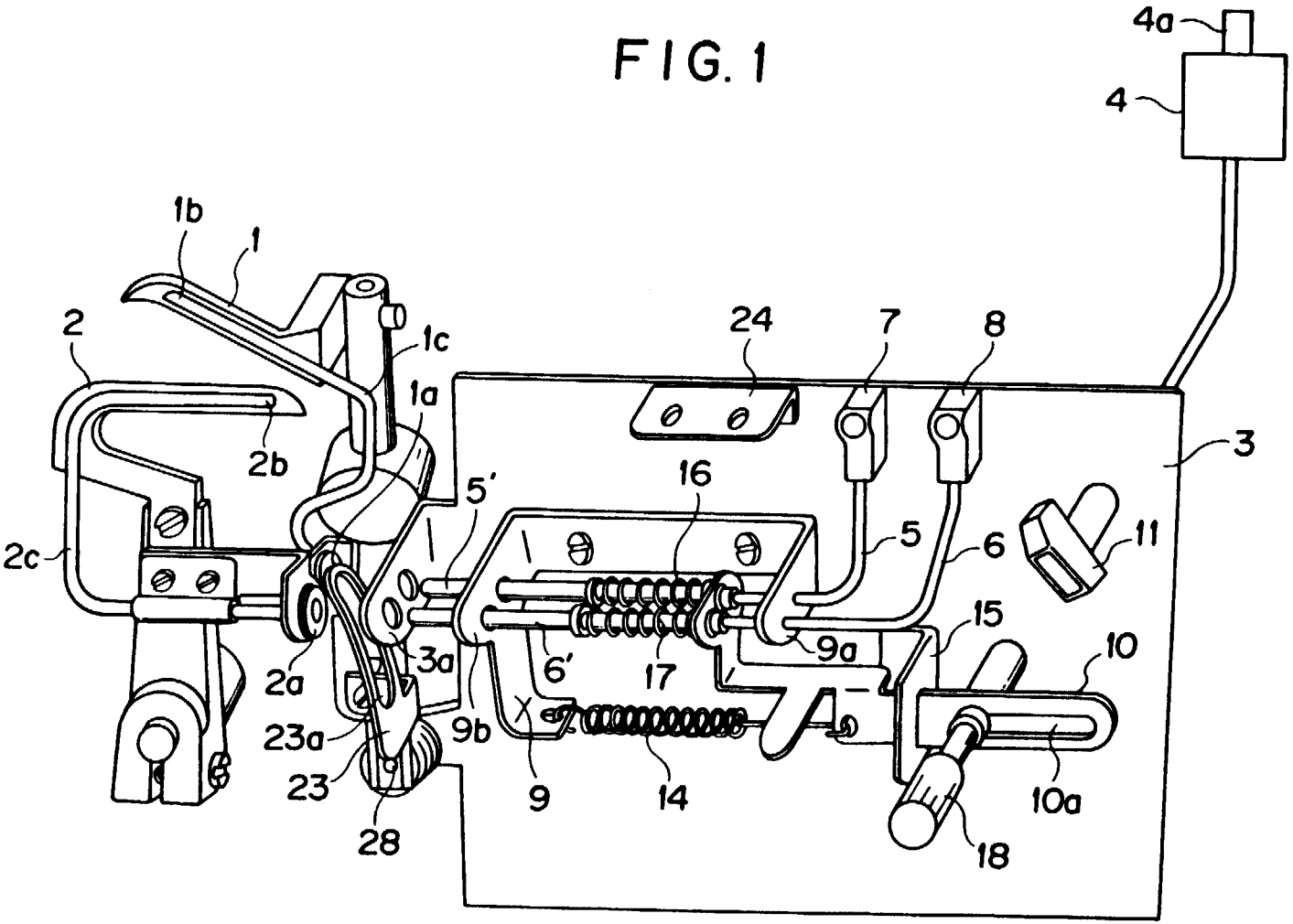
FIG. 1 shows a whole threading device for a sewing machine in accordance with an embodiment of the invention.

FIG. 1 shows an entire threading device machine of the invention for use on an over-lock machine provided with two loopers (upper looper 1 and lower looper 2). The threading device is attached to a mount plate 3 forming the front surface of the sewing machine.

The threading device is essentially formed of gas supply means, i.e., an air pump 4 for supplying air, hollow thread guide means, i.e., connecting conduits 5 and 6 and connecting conduits 5' and 6' for transferring the air supplied from the air pump to the loopers 1 and 2, thread introduction portions 7 and 8 which are connected to the conduits 5 and 6, respectively, and connecting means, i.e., a guide plate 9 and a connecting portion moving plate 10, for connecting ends of conduits 5' and 6' to ends 1*a* and 2*a* of the loopers. A thread guide portion 24 for an extra thick (not shown) thread is attached to the mounting plate 3. The extra thick thread introduced to the thread guide portion 24 can be passed through the loopers 1 and 2, using a thread conveyed by the threading device.

Figure 2:
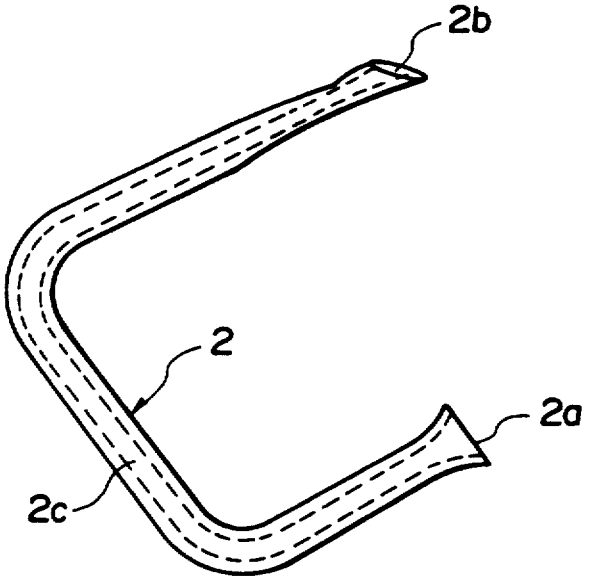
FIGS. 2(*a*) and 2(*b*) show another embodiment of a looper applied to a threading device for a sewing machine of the invention.
Figure 2:
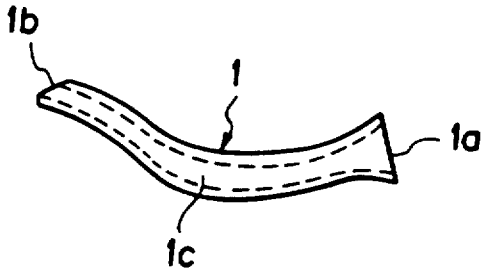

The upper looper 1 and the lower looper 2 have hollow structures extending from tip ends, i.e., thread outlets 1*b* and 2*b* to thread inlets 1*a* and 2*a*. In the embodiment shown in FIG. 1, portions of the upper looper 1 and the lower looper 2 extending from the thread outlets 1*b* and 2*b* to the thread inlets 1*a* and 2*a* are formed of annular or tubular members 1*c* and 2*c*, respectively, and the thread inlets 1*a* and 2*a* form receiver portions connected to thread introduction portions 7 and 8, which feed pressurized air, respectively. The receiver portions (1a and 2a) have tapered or bell-mouthed forms for facilely introducing the looper threads thereinto. The upper and lower loopers 1 and 2 themselves may be formed of hollow members, as shown in FIG. 2.

Figure 3:
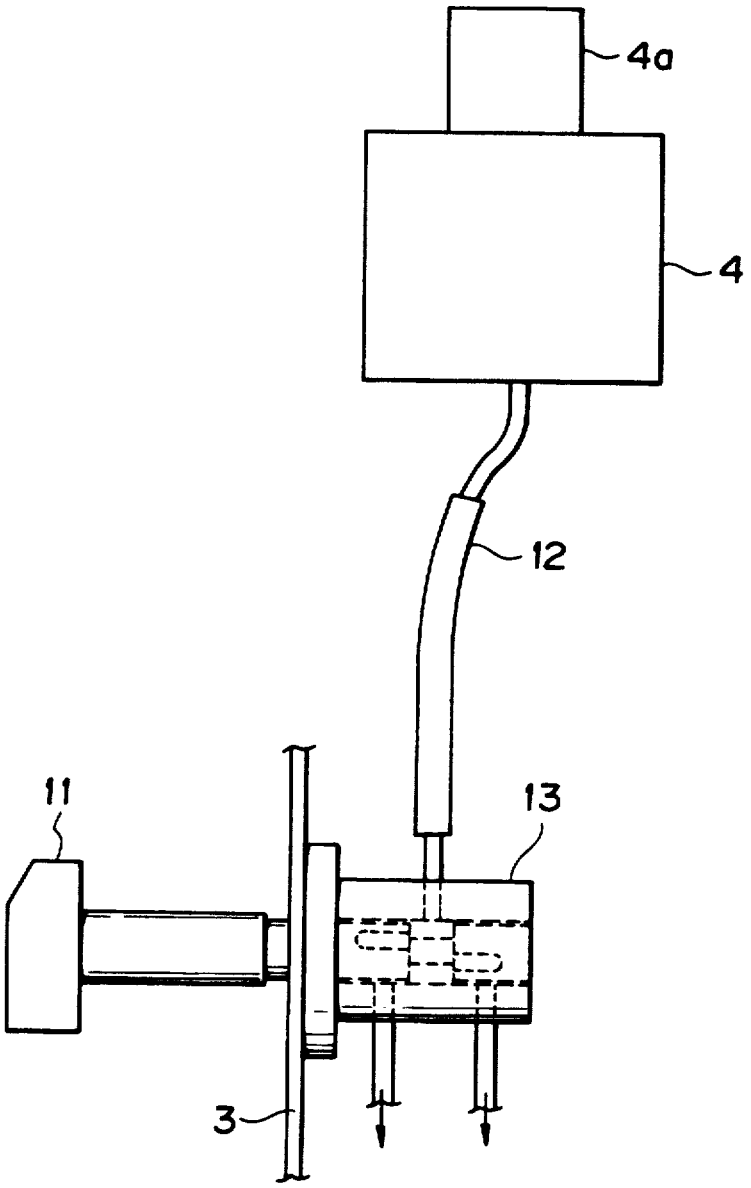
FIG. 3 shows a major portion of the threading device in FIG. 1.

The air pump 4 supplies the pressurized air to the conduit when an operation button 4a is depressed or positively operated, and draws the air from the conduit when the button 4a is moved upward or reversely operated. Although independent air pumps 4 may be associated with conduits 5 and 6, respectively, the illustrated embodiment is provided with the one air pump 4 which can selectively connected to either one of the conduits by selector means, i.e., a selector lever 11. As shown in FIG. 3, the air pump 4 is connected through a pipe 12 to a selector valve 13. By operating the selector lever 11, the selector valve 13 connects the pipe 12 to one of the conduits 5 and 6. Instead of the two-way valve, the selector valve 13 may be formed of various well-known valves for fluid, such as a three-way valve, depending on the number of the loopers.

Figure 4:
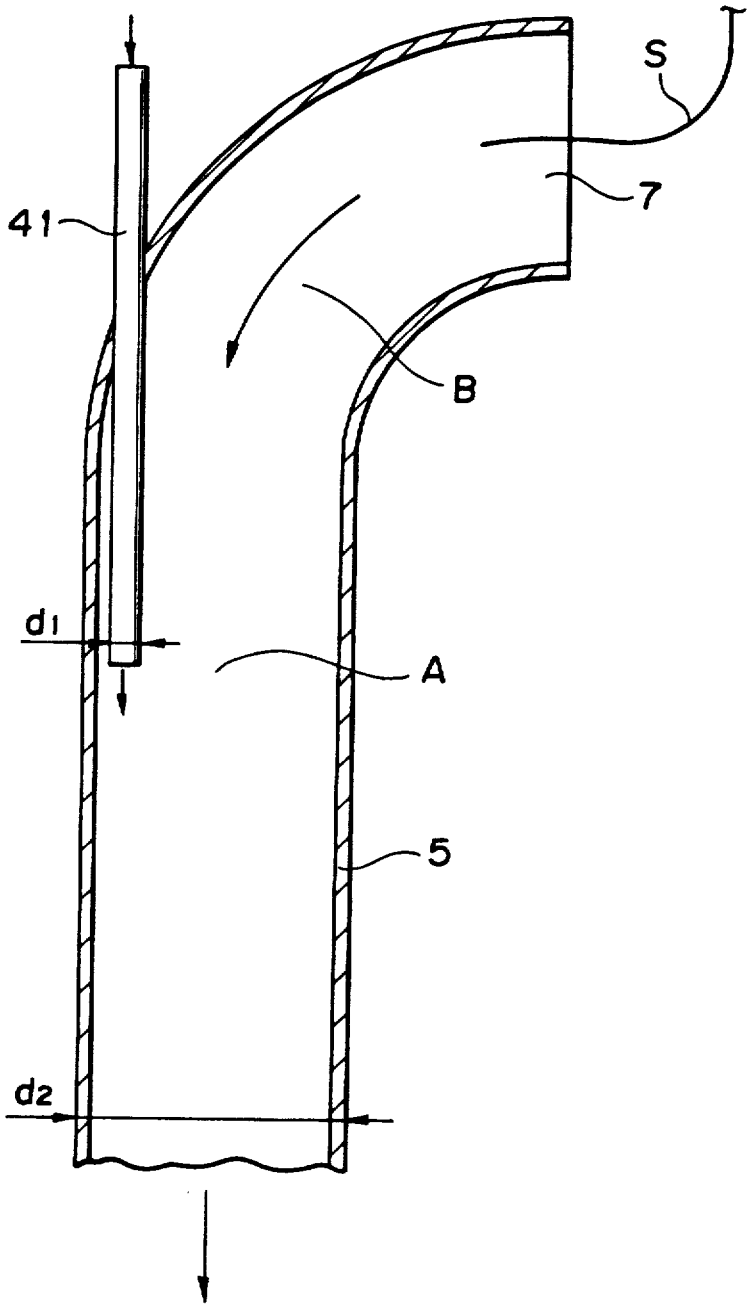
FIG. 4 is a shows a principle of the threading operation.

Each of the conduits 5 and 6 has one end connected to the selector valve 13 for the air pump 4, so that the pressurized air is introduced thereinto, and the thread is transferred to the looper, utilizing the pressurized air. As schematically shown in FIG. 4, the conduit 5 is provided at its one end with a thread introduction portion 7 (8), to which a pressurized gas introduction pipe (will be called as "air introduction pipe") 41 leading from the pump 4 is connected (the conduit 6 is not described in detail because it has the same structure). The end of the air introduction pipe 41 is preferably inserted into the conduit 5. Although not shown, the thread introduction portion 7 preferably has a bell-mouthed form for facilitating the insertion of the thread.

When the pressurized air is supplied from the air introduction pipe 41, a flow of air at a high velocity is formed at a region A near the outlet of the air introduction pipe 41. Therefore, a force directed toward the region A is generated in a region B in and near the thread introduction region 7 by the Bernoulli's theorem, so that the thread S inserted into the thread introduction portion 7 is drawn into the conduit 5. The thread is fed to the thread outlet by the air flowing at the high velocity from the air introduction pipe 41. The air introduction pipe 41 has a diameter larger than that of the conduit. Therefore, if a relatively large amount of pressurized air were supplied, the air existing in a long section between the conduit 5 and the thread outlet 1b of the looper would form a resistance and act to push back the pressurized air. Accordingly, the amount of the air supplied from the air introduction pipe 41 is desirably determined so that the air is smoothly discharged from the thread outlet 1b without such resistance and a flow velocity sufficient to feed the thread S can be obtained. For example, assuming that the air introduction pipe 41 has a diameter of $d_1$ and the air guide means, i.e., conduit 5 has a diameter of $d_2$, a relationship of $d_1 < d_2$ is preferably. By determining the diameter of the air introduction pipe 41 as described above, a flow velocity sufficient to draw the thread can be obtained by a relatively small amount of air, and the thread S can be smoothly transferred to the thread outlet 1b, while suppressing resistance during the transfer.

Figures 5A, 5B, 5C, 5D, 5E:
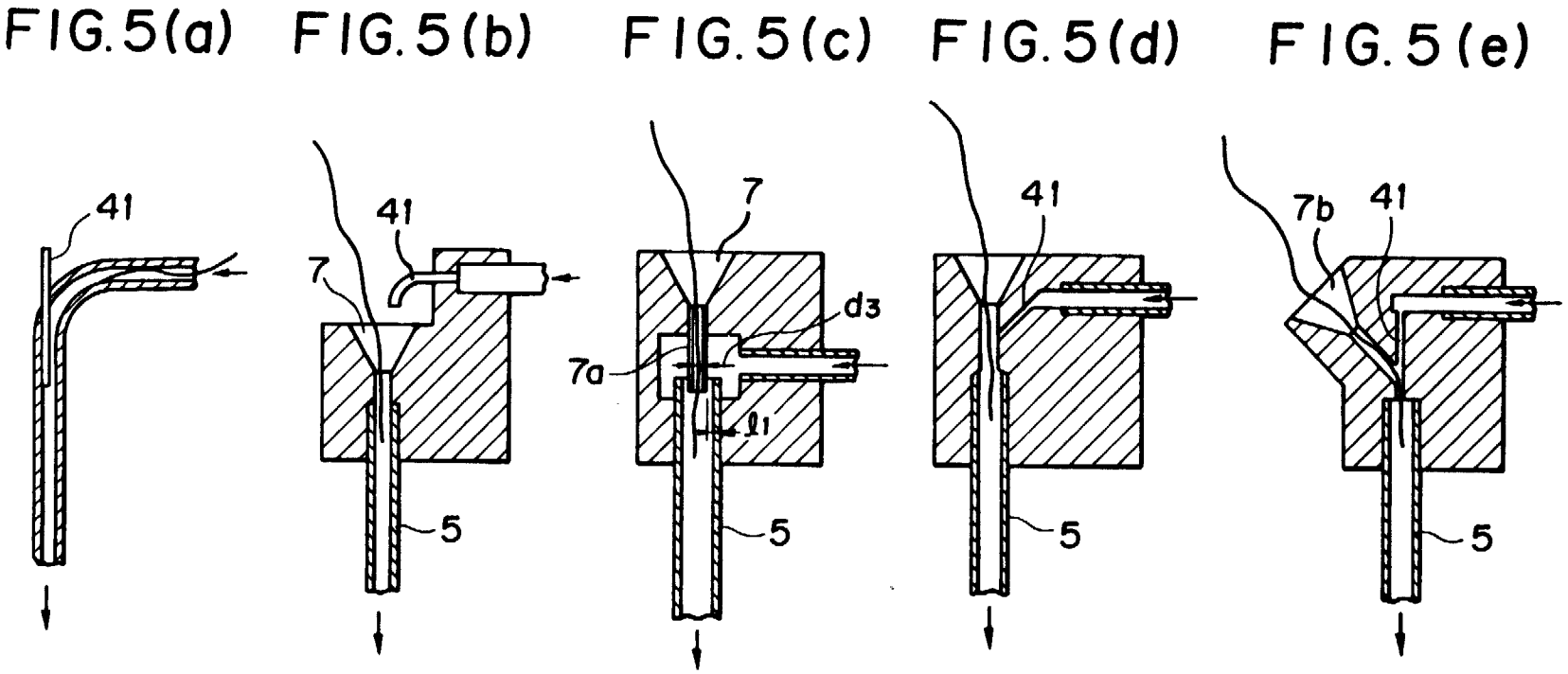
FIGS. 5(*a*) through 5(*e*) show several embodiments of a thread introduction portion.

Another embodiment of the conduit 5 and the air introduction pipe 41 will be described below with reference to FIG. 5(a)-(e). In FIG. 5(a), the conduit 5 has a constant diameter throughout its length, and has a portion connected to the air introduction pipe 41 inserted thereinto, which is similar to FIG. 4. In FIG. 5(b), the conduit 5 and the air introduction pipe 41 at the air pump side are separated, and the thread introduction portion 7 is connected to the conduit 5. The Bernoulli's theorem is not utilized, and the flow itself of the pressurized air is utilized. The manufacturing is easy, similarly to the embodiment in FIG. 5(a), but a relatively large air pump is required. In FIG. 5(c), an inserting pipe 7a of the thread introduction portion 7 is inserted into the conduit 5. The thread is drawn by a negative pressure, which is generated when the air flows through a narrow space between the conduit 5 and the thread inserting pipe 7a. In this embodiment, a distance $l_1$ between the conduit 5 and the thread inserting pipe 7a and a diameter $d_3$ of the thread inserting pipe 7a have a relationship of $l_1 < d_3$. In the embodiments of FIGS. 5(d) and 5(e), the air introduction pipe 41, which has a diameter smaller than that of a connecting portion between the conduit 5 and the thread introduction portion 7, is connected to the connecting portion. In FIG. 5(e), the bell-mouthed insertion opening 7b of the thread introduction portion 7 is directed toward an operator for facilitating the insertion of the thread. Of course, the conduit and the thread introduction portion in the threading device of the invention may have structures other than the illustrated structures.

Figure 6:
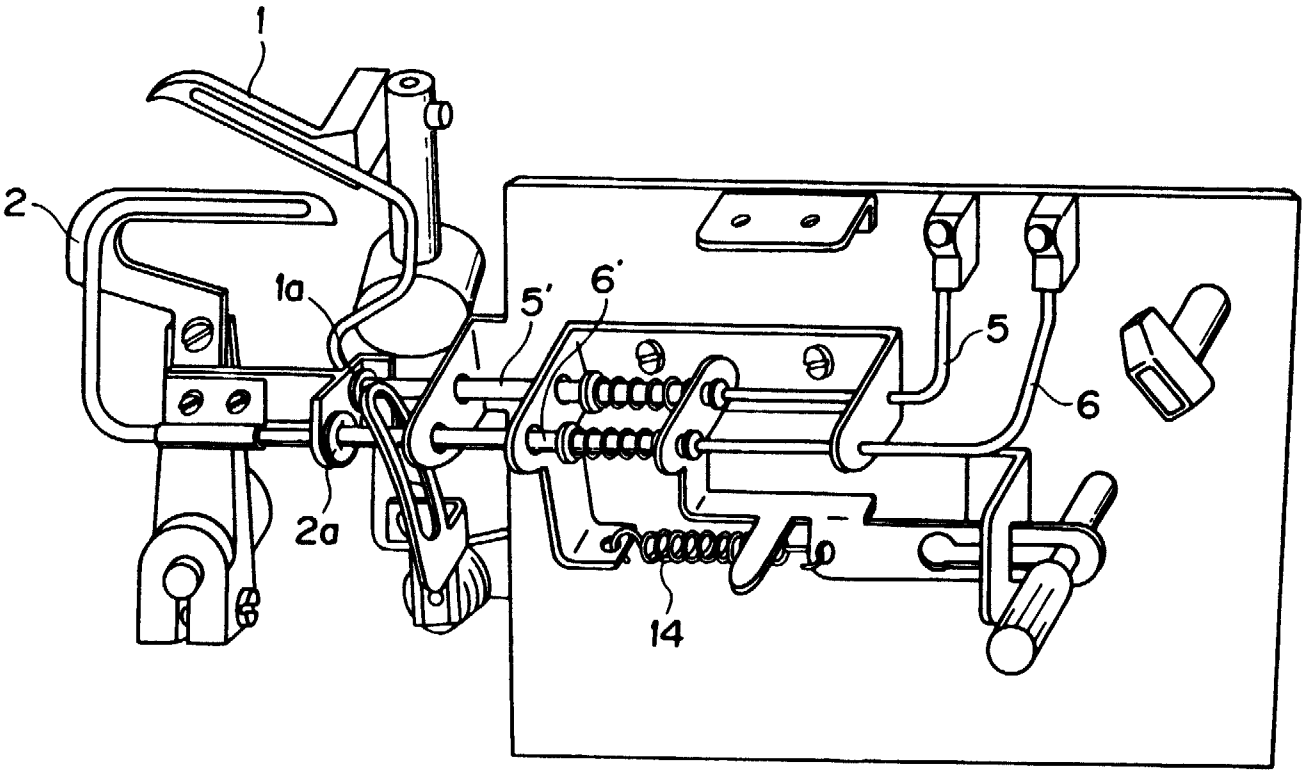
FIG. 6 shows the threading device in FIG. 1 ready for threading.

The ends of the conduits 5 and 6 at the looper side are slidably connected, in a telescopic manner, to the connecting conduits (referred to merely as "conduits" hereinafter) 5' and 6' of diameters larger than those of the conduits 5 and 6. The conduits 5' and 6' are moved and slid by connecting means described later, and the ends of the conduits 5' and 6' are connected to the receiver portions 1a and 2a of the loopers 1 and 2 (FIG. 6). These conduits 5 and 6 as well as conduits 5' and 6' are supported by a guide plate 9 fixed to the mounting plate 3. Specifically, the guide plate 9 is provided with arm portions 9a and 9b which are bent to cross the conduits 5 and 6. The arm portion 9a is provided with holes for fixing the conduits 5 and 6. The arm portion 9b is provided with holes which slidably carry the conduits 5' and 6'. Similarly to the guide plate 9, the mounting plate 3 is provided with an arm portion 3a which is bent to cross the conduits 5' and 6'. The arm portion 3a is provided with holes through which the conduits 5' and 6' can pass. The holes in the mounting plate 3 have diameters slightly larger than those of the holes in the guide plate 9 so as to allow radial shift of the moving conduits 5' and 6'. Owing to the bell-mouthed forms (tapered walls) of the receiver portions 1a and 2a of the loopers 1 and 2, possible radial deviation of the centers of the conduit 5' and 6' from the centers of the loopers (annular members 1c and 2c) is eliminated when the conduits 5' and 6' are pressed against the receiver portions 1a and 2a, and the centers coincide with each other.

Figure 7A:
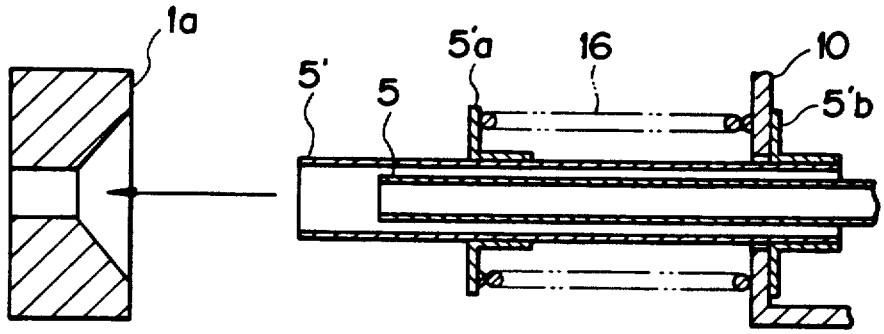
FIGS. 7(*a*) and 7(*b*) show a major portion of the threading device in FIG. 1.
Figure 7B:
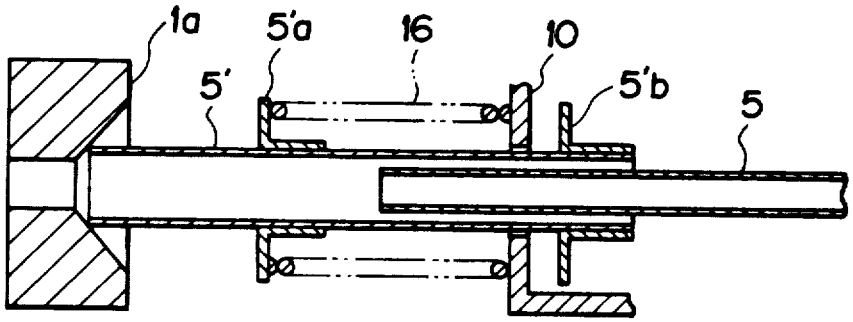

Connection means for connecting the conduits 5' and 6' to the receiver portions 1a and 2a of the loopers 1 and 2 will be described below. The connecting means is formed of the guide plate 9 fixed to the mounting plate 3, a connecting portion moving plate 10 and a spring 14 interposed between the ends of the connecting portion moving plate 10 and the guide plate 9. Also a support plate 15 for supporting and guiding the connecting portion moving plate 10 is fixed to the mounting plate 3. The conduits 5' and 6' are connected to the connecting portion moving plate 10 through springs 16 and 17, and are forced together with the connecting portion moving plate 10 by the spring 14 toward the looper. FIG. 7 specifically shows a connection between the conduit 5' and the connecting portion moving plate 10 (the conduit 6' has the same connecting structure and thus will not be described below). A spring support plate 5'a and a positioning plate 5'b are fixed to the conduit 5'. The spring 16 is fixed at its one end to the spring support plate 5'a and is fixed at the other end to the connecting portion moving plate 10. In the state shown in FIG. 7 (*a*), in which the conduit 5' is not connected to the receiver portions 1a of the looper 1, i.e., in the operating state of the sewing machine, when the connecting portion moving plate 10 is pulled against the biasing force of the spring 14 to a non-operating position (rightward in the figure), the conduit 5' is simultaneously moved rightward through the positioning plate 5'b. When the connecting portion moving plate 10 is in the non-operating position (right end position), the spring 16 forces the conduit 5' against the connecting portion moving plate 10 to prevent its movement. Meanwhile, when the connecting portion moving plate 10 operates to connect the conduit 5' to the receiver portions 1a of the looper 1, the spring 16 absorbs the impact caused when the conduit 5' is brought into contact with the receiver portion 1a by the spring 14. Further, when the conduit 5' is connected to the receiver portion 1a, the spring force of the compressed spring 16 cooperates with the spring force of the spring 14 to fix the conduit 5' to the receiver portion 1a.

The connecting portion moving plate 10 is provided with a long aperture 10a, in which a safety device, i.e., a stopper 18 is engaged. The engagement of the stopper 18 in the long aperture 10a of the connecting portion moving plate 10 restricts the movement of the connecting portion moving plate 10 during the rotation of the main shaft (not shown), and restricts the rotation of the main shaft when the connecting portion moving plate 10 is located at the looper side (i.e., in the threading operation).

Figure 8A:
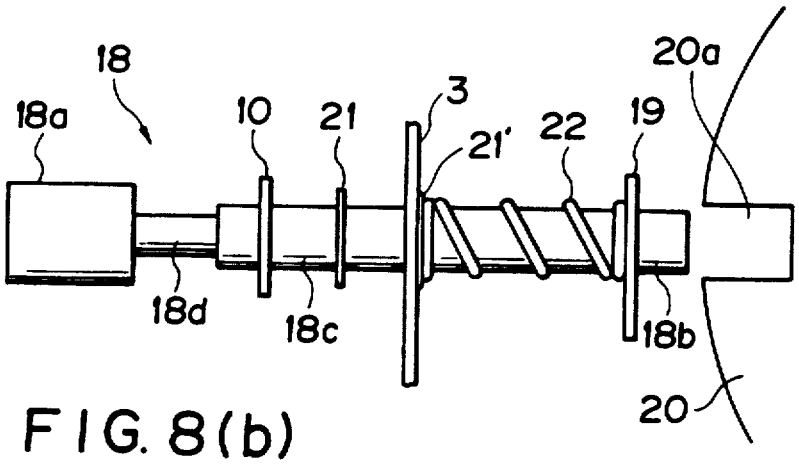
FIGS. 8(*a*) and 8(*b*) show a major part of a threading device in FIG. 1.
Figure 8B:
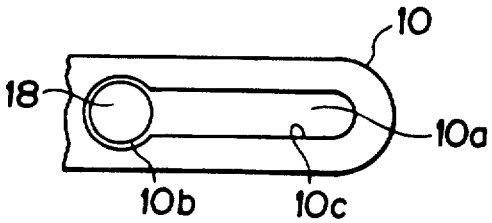

As shown in FIG. 8(*a*), the stopper 18 is slidably carried by the mounting plate 3 and a stop bearing 19, and its axial movement is restricted by washers 21 and 21' fixed to the stopper 18. Also the stopper 18 is biased away from the stopping and positioning plate 20 by a spring 22 interposed between the washer 21' fixed to the stopper 18 and the stop bearing 19. In these structures, when the stopper 18 is moved rightward in the figure by pushing an operation portion 18a of the stopper 18, its end 18b engages a recess 20a in the stopping and positioning plate 20 rotating together with the main shaft, and the axial movement is restricted by the contact of the washer 21 with the mounting plate 3. When the stopper 18 goes to the axially movable state within the long aperture 10a, the stopper 18 is moved leftward in the figure by the biasing force of the spring 22 until the washer 21' contacts the mounting plate 3.

The structure for restricting the movement of the connecting portion moving plate 10 during the rotation of the main shaft will be described below. The stopper 18 has axially juxtaposed middle diameter portion 18c and small diameter portion 18d. Correspondingly, the long aperture 10a in the connecting portion moving plate 10 is formed of a circular portion 10b and a groove 10c (see FIG. 8(*b*). The circular portion 10b has a diameter which is slightly larger than the diameter of the middle diameter portion 18c to allow engagement by the middle diameter portion 18c of the stopper 18. The groove 10c has a width slightly larger than the diameter of the small diameter portion 18d to allow the engagement of the small diameter portion 18d, but is smaller than the diameter of the middle diameter portion 18c. Accordingly, when the middle diameter portion 18c of the stopper 18 is engaged with the circular portion 10b of the connecting portion moving plate 10, as shown in FIG. 8(*b*), the axial movement of the stopper 18 is allowed, but the movement of the connecting portion moving plate 10 toward the looper is inhibited.

In this state, when the main shaft is in a predetermined position and the stopper 18 is pushed, its end 18b engages the recess 20a in the stopping and positioning plate 20. Simultaneously, the connecting portion moving plate 10 moves toward the looper with the groove 10c engaged by the small diameter portion 18d of the stopper, because the connecting portion moving plate 10 is forced toward the looper by the spring 14. Thus, the device goes into a state allowing the threading operation. In this state engagement between, the end 18b of the stopper 18 and recess 20a inhibits the rotation of the main shaft.

Further, in the automatic threading device shown in FIG. 1, the looper thread take-up 23 is disposed at the connecting portion of the loopers 1 and 2 and the conduits 5' and 6', i.e., between the receiver portions 1a and 2a of the loopers 1 and 2 and the arm portion 3a of the mounting plate 3. The looper thread take-up 23 is fixed to the upper looper mounting shaft in the figure, and reciprocates substantially in the vertical direction in accordance with the rotation of the main shaft to pull up and feed the looper thread of the lower looper 2 during the sewing operation. The looper thread take-up 23 may be driven by a drive system, other than that utilizing the motion of the upper looper mounting shaft. Meanwhile, the upper looper 1 itself reciprocates substantially in the vertical direction, so that it cooperates with the thread inlet 1a and a thread guide hole (not shown) formed in the arm portion 3a of the mounting plate 3 to achieve the function as the looper thread take-up. The looper thread take-up 23 is provided with a long aperture 23a, of which upper and lower ends pull and feed the looper thread. In the threading operation, i.e., when the conduit 6' is connected to the receiver portion 2a of the lower looper 2, the connection of the conduit 6' is carried out through the long aperture 23a.

A threading operation using the threading device of the invention thus constructed will be described below.

First, the main shaft of the sewing machine is rotated while pushing the operation portion 18a of the stopper 18. When the end 18b of the stopper 18 engages the recess 20a in the stopping and positioning plate 20 which rotates synchronously with the main shaft, further rotation of the main shaft is prevented. Meanwhile, the stopper 18 thus pushed moves toward the stopping and positioning plate 20, and the guide moving plate 10 is disengaged from the middle diameter portion 18c of the stopper 18. Also the small diameter portion 18d engages the groove 10c of the long aperture 10a in the guide moving plate 10, and thus is moved toward the looper by the biasing force of the spring 14. In this state, the ends of the conduits 5' and 6' fixed to the moving guide plate 10 through the springs 16 and 17 contact the receiver portions 1a and 2a of the loopers 1 and 2 through the holes in the arm portion 3a of the mounting plate 3. In this operation, the springs 16 and 17 fitted onto the conduits 5' and 6' absorb the contact impact, and provide the forces for pushing the ends of the conduits 5' and 6' into the receiver portions 1a and 2a. Also, since the receiver portions 1a and 2a have the bell-mouthed forms, the centers of the ends of the conduits 5' and 6' automatically coincide with the centers of the annular members 1c and 2c of the loopers.

In this state, the thread S of an appropriate length (about 1 cm) is inserted into one of the thread introduction portions, e.g., the thread introduction portion 7 for the upper looper. Also, the selector lever 11 for the air pump 4 is switched to the upper looper side (conduit 5 side), so that the operation button 4a is depressed to feed pressurized air into the conduit 5. The flow of this pressurized air generates a negative pressure for drawing the thread to the near end of the air introduction pipe 41 by the Bernoulli's theorem, so that the thread S inserted into the thread introduction portion 7 is drawn into the conduit 5, and simultaneously, the flow of the pressurized air feeds the thread along the thread transferring passage extending from the looper side of the conduit 5 through the conduit 5' to the annular member 1c to quickly feed the thread from the tip end 1b of the upper looper 1. If the thread is not completely fed by one depressing operation of the air pump 4, the operation is repeated 2 or more times, whereby the threading operation can be surely completed.

Then, the selector lever 11 of the air pump 4 is switched to the lower looper side (conduit 6 side), and the operation button 4a is depressed, so that the thread S can be quickly fed to the tip end of the lower looper 2 by the pressurized air, similarly to the upper looper thread.

In the above description, the thread is drawn into the conduit 5, and is quickly fed through the thread transfer passage to the thread outlet of the looper by the positive operation of the air pump 4. However, in the threading operation of the invention, the reverse operation of the air pump 4 may be utilized for drawing the thread.

Figure 9:
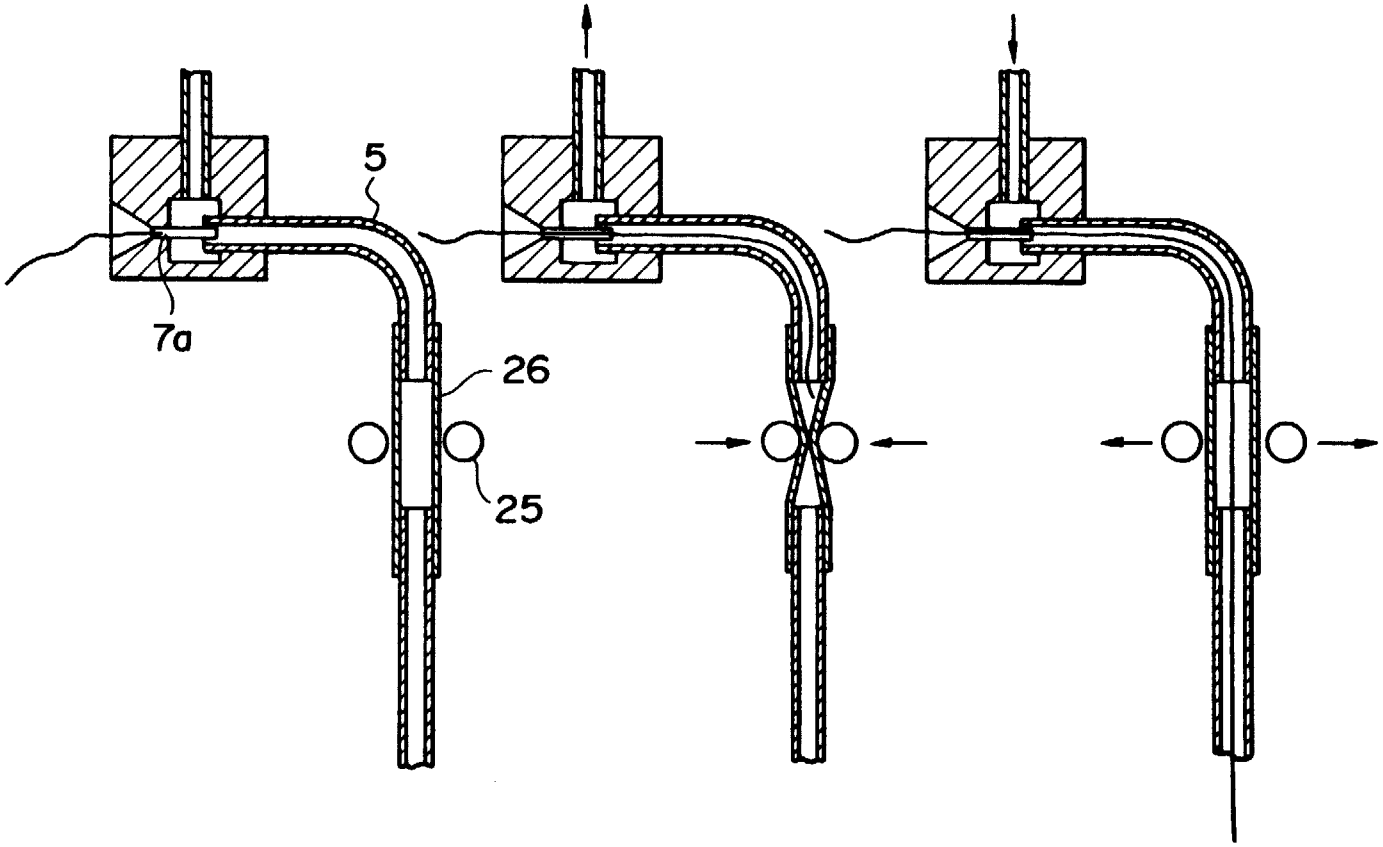
FIG. 9 shows another embodiment of a threading device for a sewing machine of the invention.

A threading device suitable to this threading method is shown in FIG. 9. In FIG. 9, the conduit 5 is provided with a valve 25 for closing the thread transferring passage. The air introduction portion 7 has a structure similar to that shown in FIG. 5(c). That is; it has a structure in which a thread inserting pipe 7a is inserted into the conduit 5. Also, the thread transferring passage of the conduit 5 is formed of two conduits connected by a flexible member such as a plastic tube or a rubber tube 26, and the valve 25 is disposed to pinch rubber tube 26. The valve 25 pinches the rubber tube 26, when required, to close the transferring passage in the conduit 5.

In the above structure, the operation button 4a of the air pump 4 is depressed to discharge the air in the air pump 4. In this state, the valve 25 of the conduit 5 is operated to close the same. Then, while keeping the operation button 4a in the depressed position, the thread S is inserted through the thread introduction portion 7, and the operation button 4a is released. Thereby, the operation button 4a lifts, and a flow of the air returning to the air pump 4 is generated in the conduit 5. This back-flowing air draws the thread S, which is inserted through the thread inserting opening 7b, into the conduit 5. During this operation, the thread S is not pulled toward the air pump, but is pulled toward the thread transferring side of the conduit 5, because the thread introduction portion 7 has the end inserted into the thread transferring side of the conduit 5. Thereafter, the operation button 4a is depressed to feed the pressurized air to the conduit 5. Owing to the flow of the pressurized air, the thread S drawn into the conduit 5 is quickly fed through the thread transferring passage, which extends through the conduit 5' to the annular member 1c, to the tip end 1b of the upper looper 1. In this case, the thread S can be quickly passed up to the looper, because the thread S has been previously drawn into the conduit 5 by the reverse operation of the air pump 4. The thread can be passed through the lower looper 2 in a similar manner by operating the selector lever 11.

Although in the embodiment described above, the pressurized gas supply means may be formed of any of various devices, other than the air pump described above, which can feed gas at an appropriate flow rate.

Further, the pressurized gas supply means is not essential in the threading device of the sewing machine in the invention. In this case, a threader 27 shown in FIG. 10, which is formed of a wire member having flexibility and appropriate rigidity, may be used to pass the thread from the thread introduction portion to the tip end of the looper. Also in this case, the thread guide is formed of the hollow conduit, so that the complicated thread passing operation is not necessary, and the threading operation can be facilitated.

The foregoing is a technique for threading ordinary looper thread. In order to pass an extra thick thread which cannot be passed through the thread guide means (conduits 5 and 6), one of the above described techniques is used to feed the thread S to the tip end of the looper. Then, the thread is cut at a position upstream to the looper, i.e., between the thread introduction opening of the looper and a position between the conduits 5' and 6, and the extra thick thread passed through the thread guide portion 24 is tied to the thread S at the looper side. Then, the thread S projected from the looper tip end is pulled, whereby the extra thick thread can be pulled through the tip end.

Figure 10:
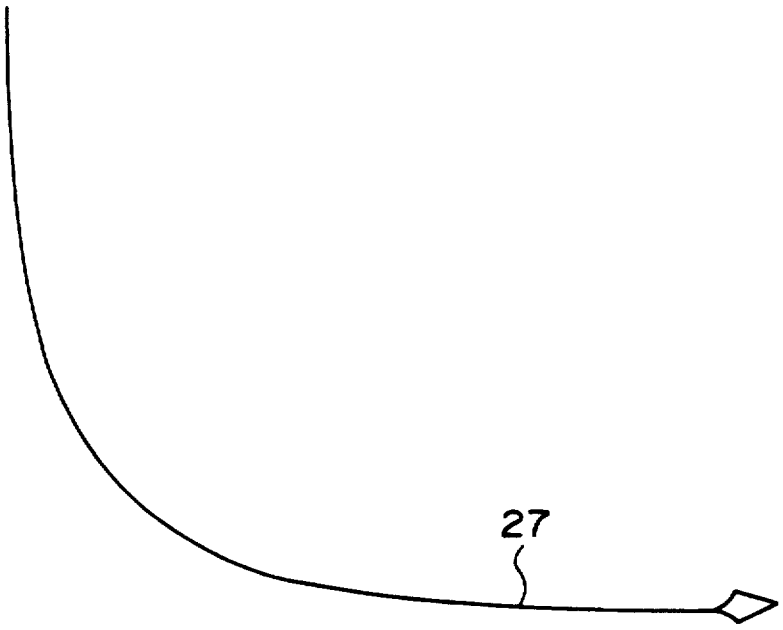
FIG. 10 shows a threader applied to a threading device for a sewing machine of the invention.
Figure 11:
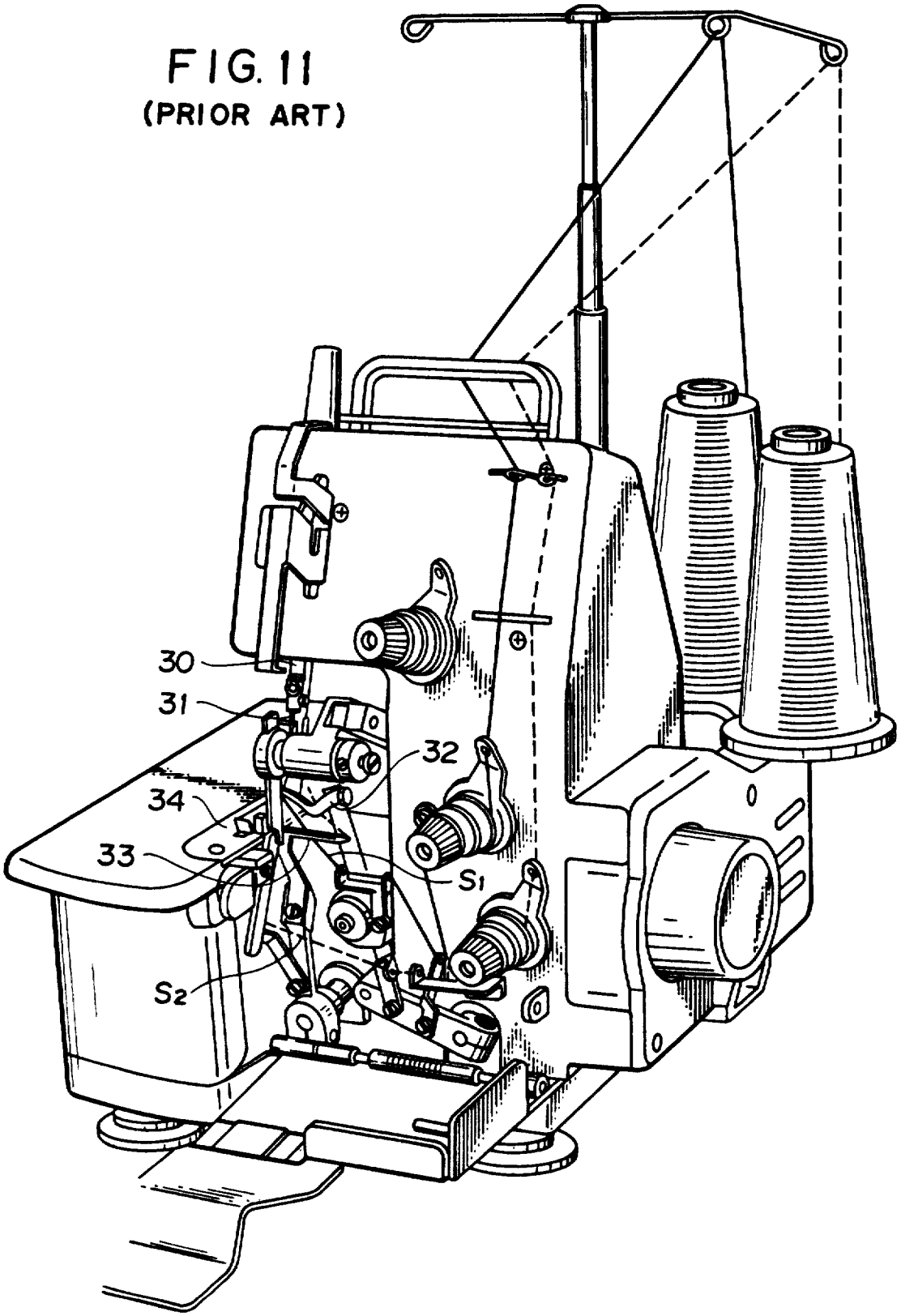
FIG. 11 (PRIOR ART)
FIG. 11 shows a conventional overlock machine.
Figure 12:
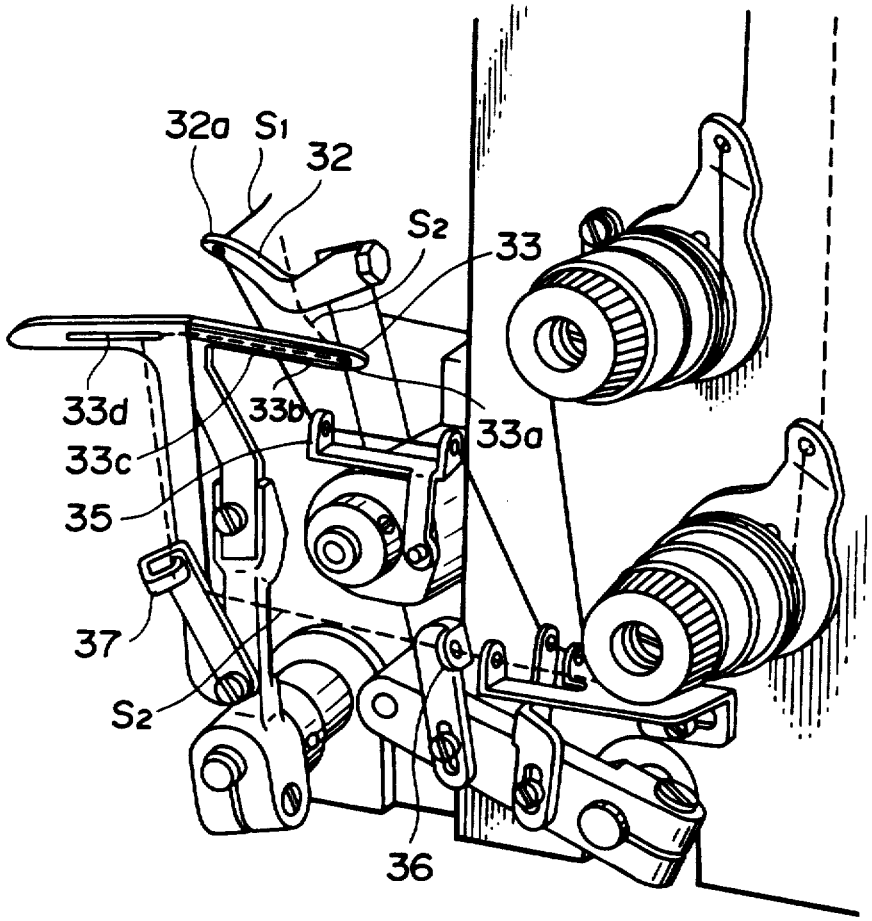
FIG. 12 (PRIOR ART)
FIG. 12 shows a conventional threading passage.

In the above description, the sewing machine is provided with a looper having a hollow structure. The threading device of the invention, however, may be applied not only to a sewing machine provided with the looper of the hollow structure, but also to a sewing machine provided with a conventional looper. In this case, the threading device of the invention is used to pull the thread out of the ends of the conduits 5' and 6', and then, the pulled thread is inserted through the looper, using the threader 27 as shown in FIG. 10. Also in this case, the conventional complicated threading operation is not required, so that the threading can be facilely carried out.

Of course, the threading device and method of the invention can be applied not only to the three-thread overlock sewing machine provided with the two loopers but also to any sewing machine provided with one or more loopers.

As can be seen from the embodiments described above, in the threading device of the sewing machine of the invention, the thread outlet at the tip end of the looper is in communication with the thread introduction portion, into which the thread is inserted, through the conduit (hollow thread guide means). Therefore, a complicated threading operation is not required, and the threading operation can be carried out with a good operability. Accordingly, mistake in the threading operation as well as the dangle of the thread on its way and thus the entangling of the inserted looper thread with other thread can be prevented. Further, according to the threading device of the invention, the flow of the pressurized gas supplied into the hollow thread guide means is utilized to feed the thread. Therefore, the threading operation can be simply and quickly completed without interruption. Further, the threading device of the invention is provided with selector means for selectively directing the supply of the pressurized gas, so that the thread can be passed through a plurality of loopers by the one supply means. Moreover, the threading device of the invention is provided with the safety means which inhibits either the threading operation or the rotation of the main shaft when the other is carried out, so that the breakage of sewing machine due to maloperation can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sewing machine comprising:

at least one elongated looper with a thread inlet at one end and a thread outlet at its other end;

an elongated hollow thread guide slidably mounted on the sewing machine and having a thread receiving end for receiving a thread and a distal end for mating with the thread inlet of the one elongated looper;

means for moving said thread guide linearly between an engaged position where said distal end of said thread guide is mated with said thread inlet of the one elongated looper and a disengaged position; and means for feeding the thread from the said thread receiving end of the thread guide, through said thread guide, through the one looper and out said thread outlet, when said thread guide is located in said engaged position.

2. A sewing machine according to claim 1 wherein said one elongated looper and said hollow thread guide are tubular members.

3. A sewing machine as claimed in claim 1, wherein a looper thread take-up for drawing and feeding the thread is mounted between said thread guide means and one end of said looper.

4. A sewing machine as claimed in claim 1, wherein said sewing machine comprises two or more loopers, and a plurality of said thread guides corresponding in number to said loopers.

5. A sewing machine as claimed inclaim 1, wherein the sewing machine has a rotatable main shaft and further comprising a safety device which includes locking means for preventing rotation of the main shaft of the sewing machine when said thread guide is in said engaged position.

6. A sewing machine as claimed in claim 5 wherein said means for moving comprises:

a plate member having an elongated slot, slidably mounted on the sewing machine and fixed to said thread guide for movement therewith; and wherein said locking means comprises:

a stopper mounted within said elongated slot for axial movement, perpendicular to the linear movement of said thread guide, between a locking position preventing rotation of the main shaft and a released position.

7. A threading method for a sewing machine comprising the steps of:

supplying pressurized gas from a pressurized gas supply means through a hollow thread guide means to a thread inlet of a tubular looper, which has a hollow structure extending from said thread inlet to a tip thread outlet;

inserting a thread into a thread introduction portion of said thread guide means;

closing a portion of said thread guide means and generating a negative pressure by a reverse operation of said pressurized gas supply means to draw said thread into said thread guide means; and conveying said pressurized gas through said thread guide means by a positive operation of said pressurized gas supply means to feed said thread from said tip thread outlet of said tubular looper by a flow of said pressurized gas.

8. A sewing machine comprising:

at least one elongated looper with a thread inlet at one end and a thread outlet at its other end;

an elongated hollow thread guide divided into at least two telescoping sections, one section being fixed in position and having a thread receiving end for receiving a thread and a second section mounted on the sewing machine for axial reciprocating movement and having a distal end for mating with the thread inlet of the one elongated looper;

means for moving said second section of said thread guide linearly between an engaged position where said distal end is mated with said thread inlet of the one elongated looper and a disengaged position; and gas supply means for introducing a gas flow into said thread guide to feed the thread through said thread guide, through the one looper and out said thread outlet, when said thread guide is located in said engaged position.

9. A sewing machine according to claim 8 wherein said one elongated looper and said hollow thread guide are tubular members.

10. A sewing machine as claimed in claim 9, wherein said gas supply means includes a gas introduction pipe having a diameter smaller than that of said hollow thread guide and wherein said gas introduction pipe passes through a wall of and terminates within the tubular member constituting said hollow thread guide.

11. A sewing machine as claimed in claim 8, wherein a looper thread take-up for drawing and feeding the thread is mounted between said thread guide means and one end of said looper.

12. A sewing machine as claimed in claim 8, wherein said sewing machine comprises two or more loopers, and a plurality of said thread guides corresponding in number to said loopers.

13. A sewing machine as claimed in claim 12, wherein said gas supply means includes selector means for selectively feeding the gas flow to one of said plurality of thread guides.

14. A sewing machine as claimed in claim 8, wherein the sewing machine has a rotatable main shaft and further comprising a safety device which includes locking means for preventing rotation of the main shaft of the sewing machine when said thread guide is in said engaged position.

15. A sewing machine as claimed in claim 14 wherein said means for moving comprises:

a plate member having an elongated slot, slidably mounted on the sewing machine and fixed to said second section of said thread guide for movement therewith; and wherein said locking means comprises:

a stopper mounted within said elongated slot for axial movement, perpendicular to the linear movement of said thread guide, between a locking position preventing rotation of the main shaft and a released position.

16. A threading method for a sewing machine comprising the steps of:

supplying pressurized gas through a hollow thread guide means to a thread inlet of a tubular looper, which has a hollow structure extending from said thread inlet to a tip thread outlet;

inserting a thread into a thread introduction portion of said thread guide means;

conveying said pressurized gas to said thread introduction portion to generate a negative pressure at said thread introduction portion;

drawing said thread into said thread guide means, utilizing said negative pressure; and feeding said thread from said tip thread outlet of said tubular looper by a flow of said pressurized gas.

* * * * *

UNITED STATES PATENT AND TRADEMARK OFFICE

CERTIFICATE OF CORRECTION

PATENT NO. : 5,327,841

DATED : July 12, 1994

INVENTOR(S) : Kouichi SAKUMA

It is certified that error appears in the above-indentified patent and that said Letters Patent is hereby corrected as shown below:

On title page, item [54] delete the title and insert —SEWING MACHINE WITH LOOPER AND LOOPER THREADER AND A THREADING METHOD—

Col. 1, line 1, delete the title and insert —SEWING MACHINE WITH LOOPER AND LOOPER THREADER AND A THREADING METHOD— line 7, after "device" insert --for--;

line 10, after "machine" insert --or--.

Col. 4, line 28, delete "part of a" and insert --portion of the--.

Signed and Sealed this

Sixteenth Day of May, 1995

*Attest:*

Bruce Lehman

BRUCE LEHMAN

*Attesting Officer*

*Commissioner of Patents and Trademarks*